US011435070B1

(12) United States Patent
Chen

(10) Patent No.: US 11,435,070 B1
(45) Date of Patent: Sep. 6, 2022

(54) LED MODULES INSTALLATION AND SUPPORT SYSTEM FOR SIGNAGE LIGHTING

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 17/669,465

(22) Filed: Feb. 11, 2022

(51) Int. Cl.

| | |
|---|---|
| ***F21V 21/34*** | (2006.01) |
| ***F21S 2/00*** | (2016.01) |
| ***F21V 19/00*** | (2006.01) |
| ***F21V 23/00*** | (2015.01) |
| *F21Y 115/10* | (2016.01) |

(52) U.S. Cl.
CPC ..... *F21V 21/34* (2013.01); *F21S 2/005* (2013.01); *F21V 19/003* (2013.01); *F21V 23/001* (2013.01); *F21Y 2115/10* (2016.08)

(58) Field of Classification Search
CPC ..... G09F 13/00; F21V 23/001; F21V 19/003; F21V 21/34; F21S 2/005
See application file for complete search history.

(56) References Cited

U.S. PATENT DOCUMENTS

2009/0186516 A1* 7/2009 Nall ..... F21V 23/002 439/417

* cited by examiner

*Primary Examiner* — Karabi Guharay
(74) *Attorney, Agent, or Firm* — Stuart M. Goldstein

(57) ABSTRACT

An LED modules installation and support system has a plurality of aligned LED modules, each having a support member which extends outwardly from a side of each of the modules. A flexible, deformable wire member extends through the support members of each of the LED modules, such that the wire member within the support members retains the modules in spaced alignment. The support members take the shape of an inverted U having a U-shaped tunnel or an enclosed support member having a through opening.

4 Claims, 7 Drawing Sheets

LED MODULES INSTALLATION AND SUPPORT SYSTEM FOR SIGNAGE LIGHTING

FIELD OF THE INVENTION

The present invention relates to the installation and support of LED modules in signage lighting.

BACKGROUND OF THE INVENTION

LED modules are used in signage lighting installations, including those requiring straight and curved runs of LED modules. Such LED modules are found, for example, in LED stringlighting, sign channel lettering fixtures, and in window displays. The LED modules provide their illumination from an electrical power source which supplies electricity via electrical wiring. Individual signage units comprising multiple LED modules require a stable and reliable means to ensure that the modules can be easily, quickly, and properly installed in the units.

The current practice for the secure installation and support of LED modules, especially for channeled lettering and design signage lighting is most inefficient. It basically involves placing each individual, electrically connected LED module within the signage or signage channels, one at a time. This is not only a time-consuming, labor intensive process, but it also is difficult to make certain that the modules are positioned and spaced properly within the signage.

Unfortunately, there is currently no means of easily and efficiently installing LED modules within signage lighting in order to save time and expense, and still provide the required stable support for the modules and the module configurations within the signage.

SUMMARY OF THE INVENTION

It is thus the object of the present invention to provide LED modules support systems and their method of installation, which overcomes the disadvantages and limitations of existing LED module installations and support means within signage lighting.

These and other objects are accomplished by the present invention, a plurality of aligned LED modules, each module having an external support member which extends outwardly from a side of the module. A flexible, deformable wire member extends through the support members of each of the LED modules, which are aligned on the wire member in the desired spacing. The flexibility of the wire member allows it to be formed into the required configuration to be inserted into signage lighting. The support members take the shape of an inverted "U" having a U-shaped tunnel or an enclosed support member having a through opening.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

The LED modules support system of the present invention is provided for positioning and configuring a plurality of aligned LED modules and maintaining them for installation within signage lighting.

Figure 1:
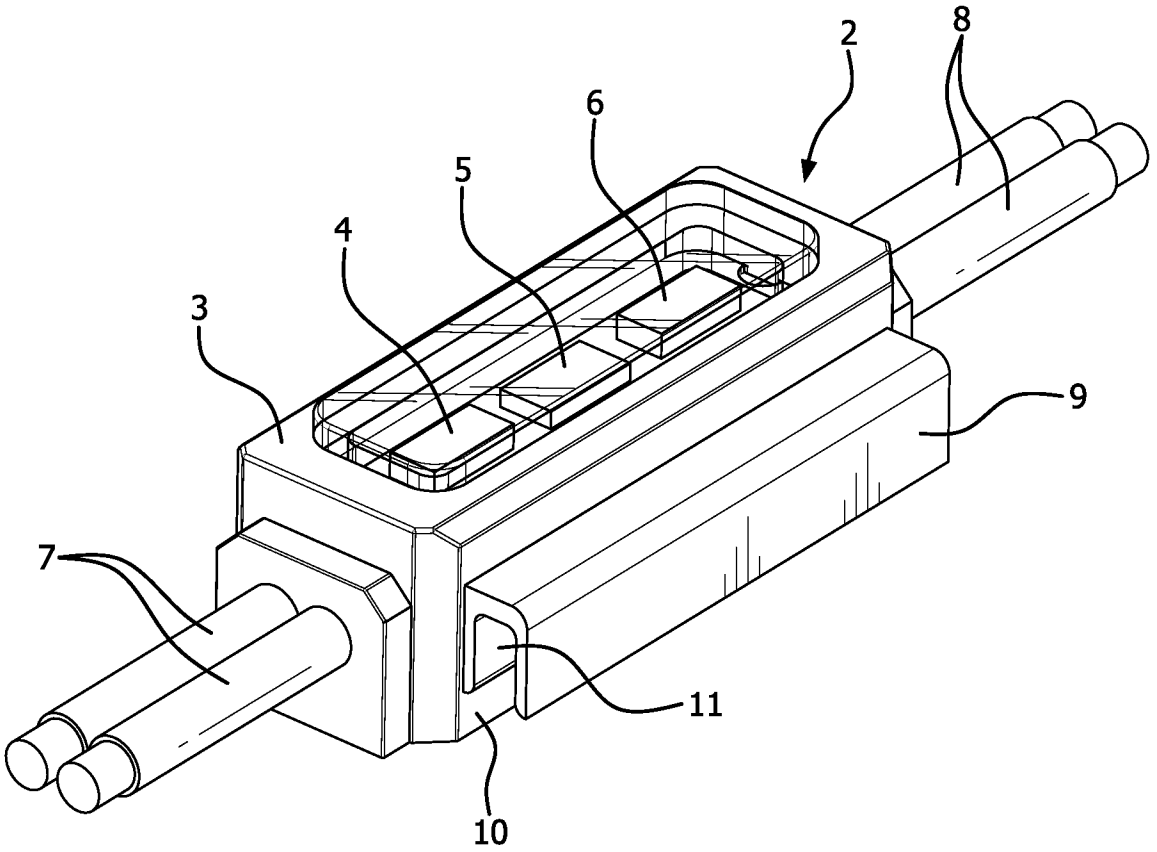
FIG. 1 is a top perspective view of an LED module of the present invention.
Figure 2:
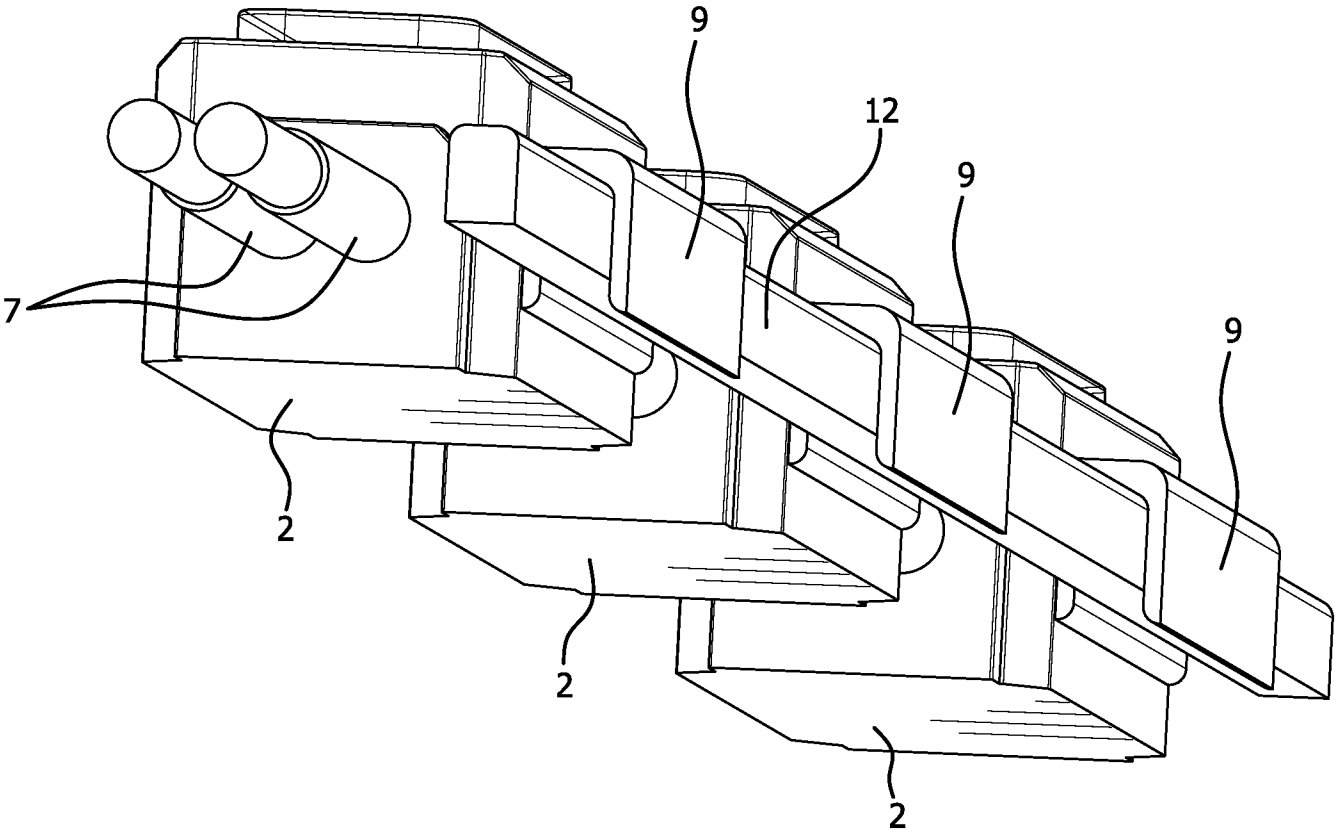
FIG. 2 is a bottom perspective view of a segment of aligned LED modules of the present invention taken from an illuminated signage system utilizing the present invention.
Figure 3:
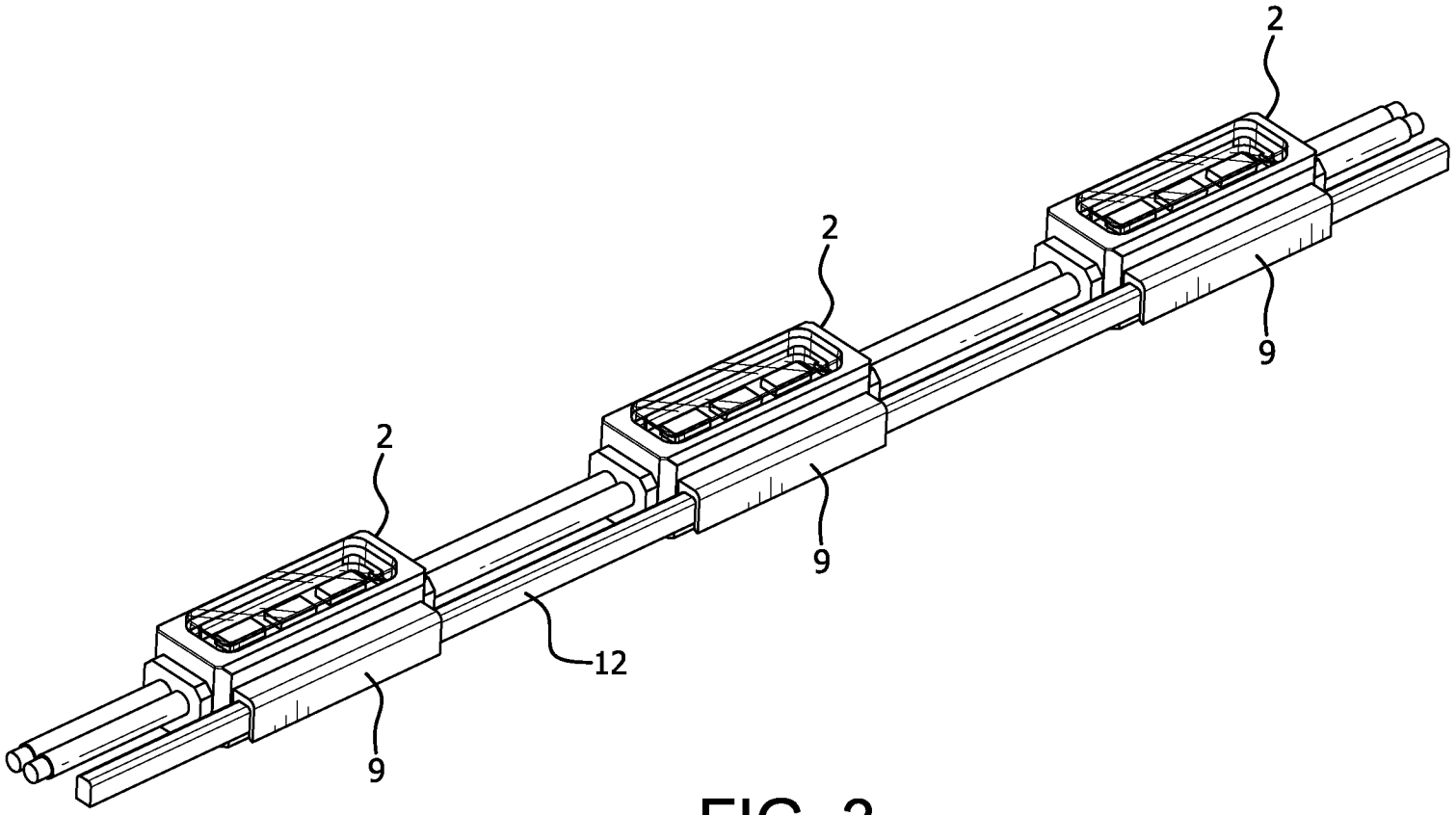
FIG. 3 is a top perspective view of a segment of aligned LED modules taken from an illuminated signage system utilizing the present invention.

FIG. 1, showing a representative LED module 2 of the present invention, comprises LED module body 3 having LED lights 4, 5, and 6 and electrical input and output wiring 7 and 8. Module support member 9 is attached to and extends outwardly from sidewall 10 of LED module 2. Support member 9 is shaped as an inverted "U" having U-shaped tunnel opening 11 extending therethrough. Support member 9 can also be integrally molded with LED module body 3.

Figure 6:
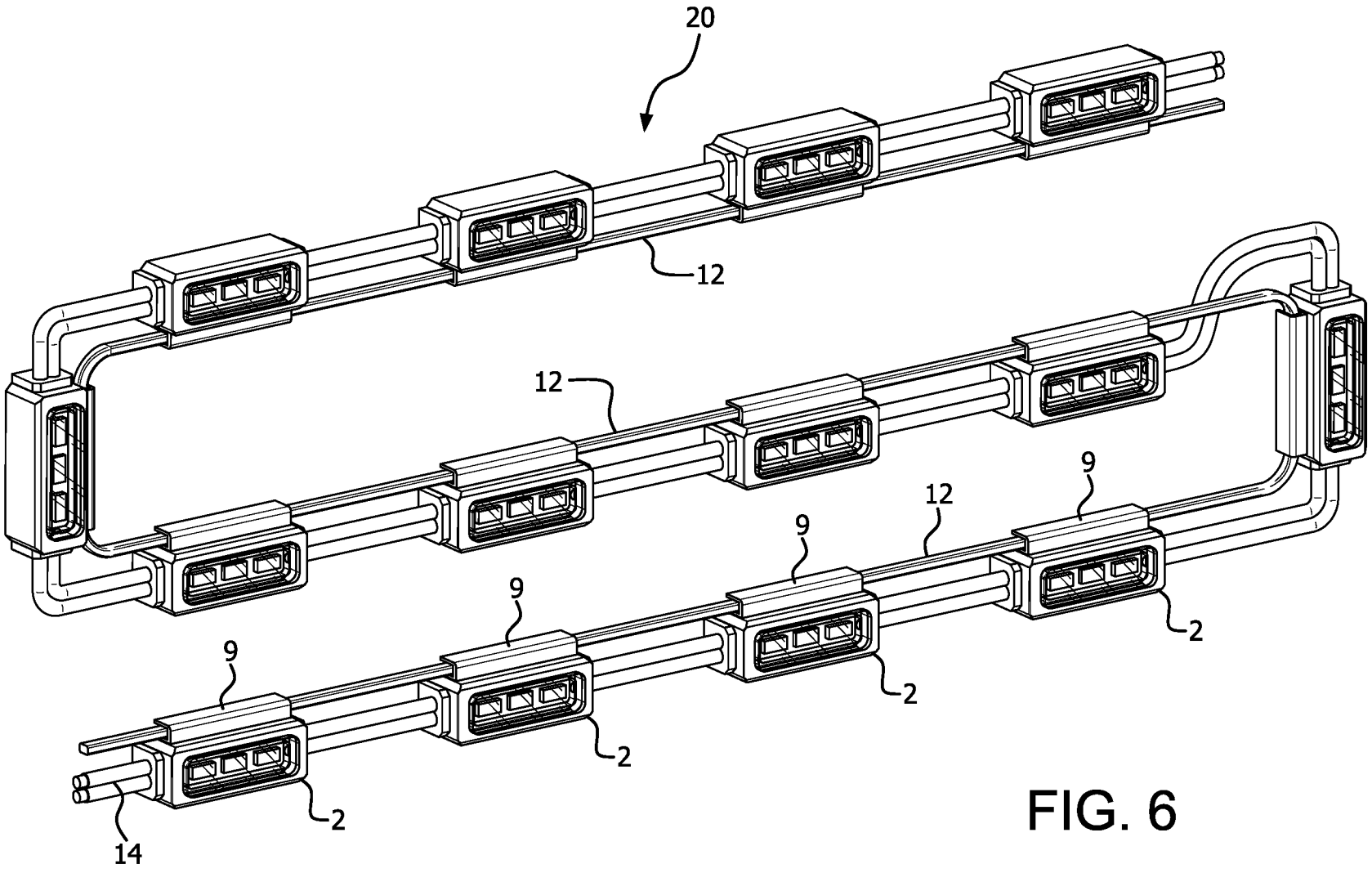
FIG. 6 is a view of exemplar lighting signage utilizing the LED module support system of the present invention, illustrating three straight runs of LED modules.
Figure 7:
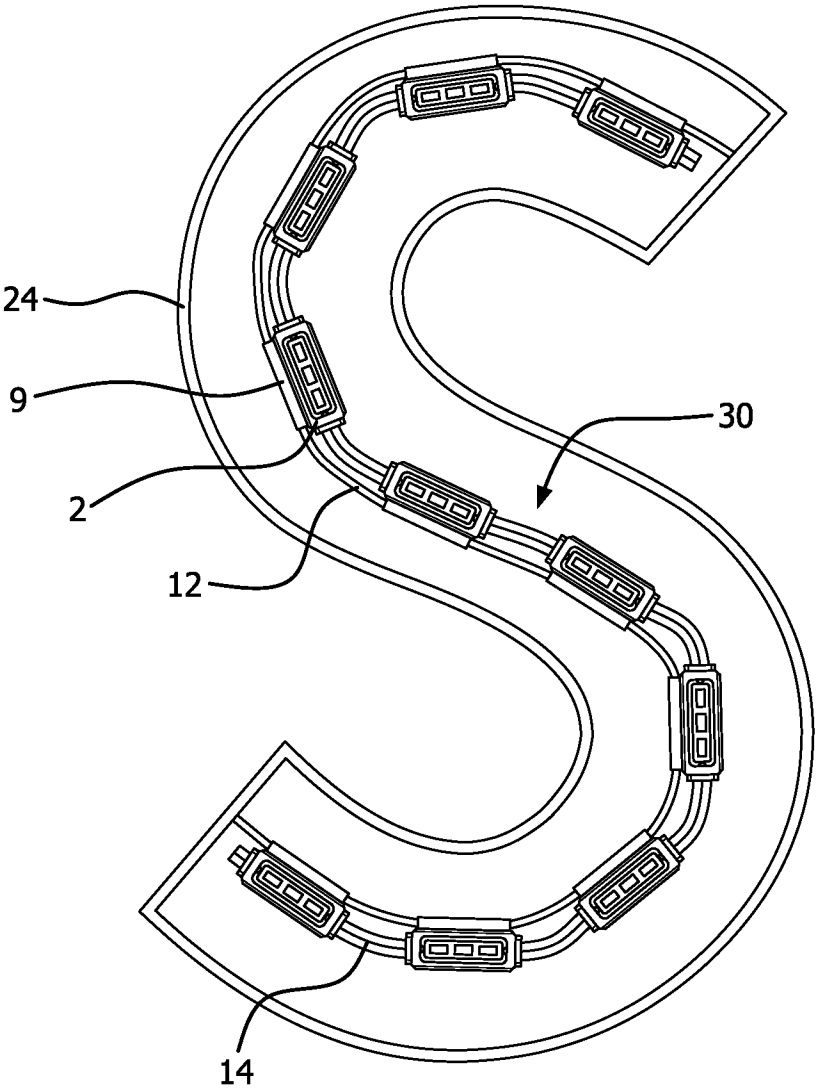
FIG. 7 is a view of exemplar lighting signage utilizing the LED module support system of the present invention, illustrating LED modules in an "S" shape configuration.

As best seen in FIGS. 6 and 7, flexible, bendable, deformable metal or equivalent material wire member 12 is inserted into tunnel openings 11 of module support members 9, extending from LED modules 2. Wire member 12 is appropriately flexed, bent, and looped into the desired signage configuration with LED modules 2 being properly spaced along the wire member.

FIG. 6 illustrates LED module lighting configuration 20, comprising straight runs of LED modules 2 properly spaced along and retained in position by wire member 12. Electrical wiring 14 provides the electricity to illuminate LED modules 2. FIG. 7 illustrates wire member 12 configured in an "S" shape, with LED modules 2 properly spaced along and retained in position by the wire member, to form LED module configuration 30.

Once the LED module configurations, e.g. configurations 20 and 30, are formed, they can easily and quickly be inserted into signage lighting or signage lighting channels.

Wire member 12 is maintained in position within support members 9 of LED modules 2, by ensuring that the width of the wire member is just minimally less than the width of tunnel opening 11. It is also contemplated that the support member will be made of somewhat resilient material in order to compress and retain wire member 12 in place. In this manner, LED modules 2 are immovably retained in their aligned configurations.

Figure 4:
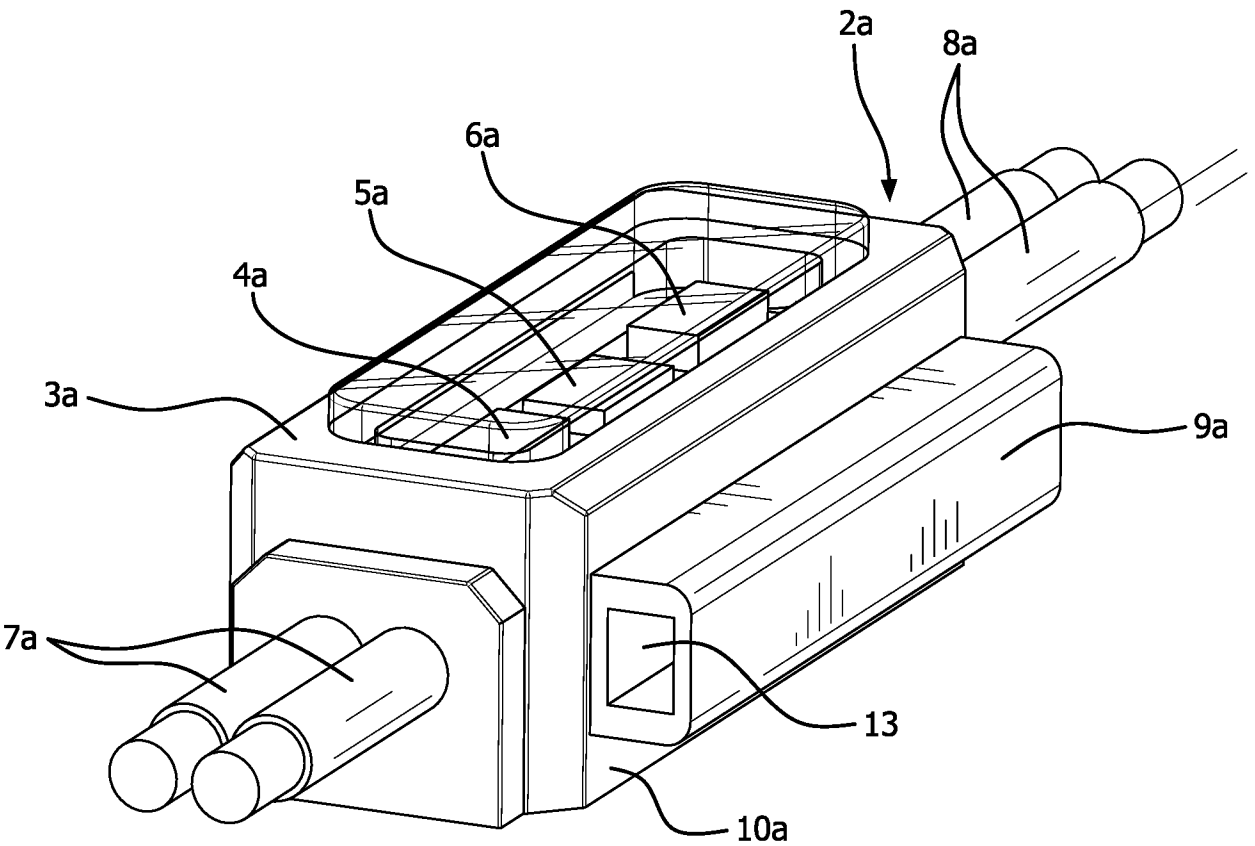
FIG. 4 is a top perspective view of an alternate embodiment of an LED module of the present invention.
Figure 5:
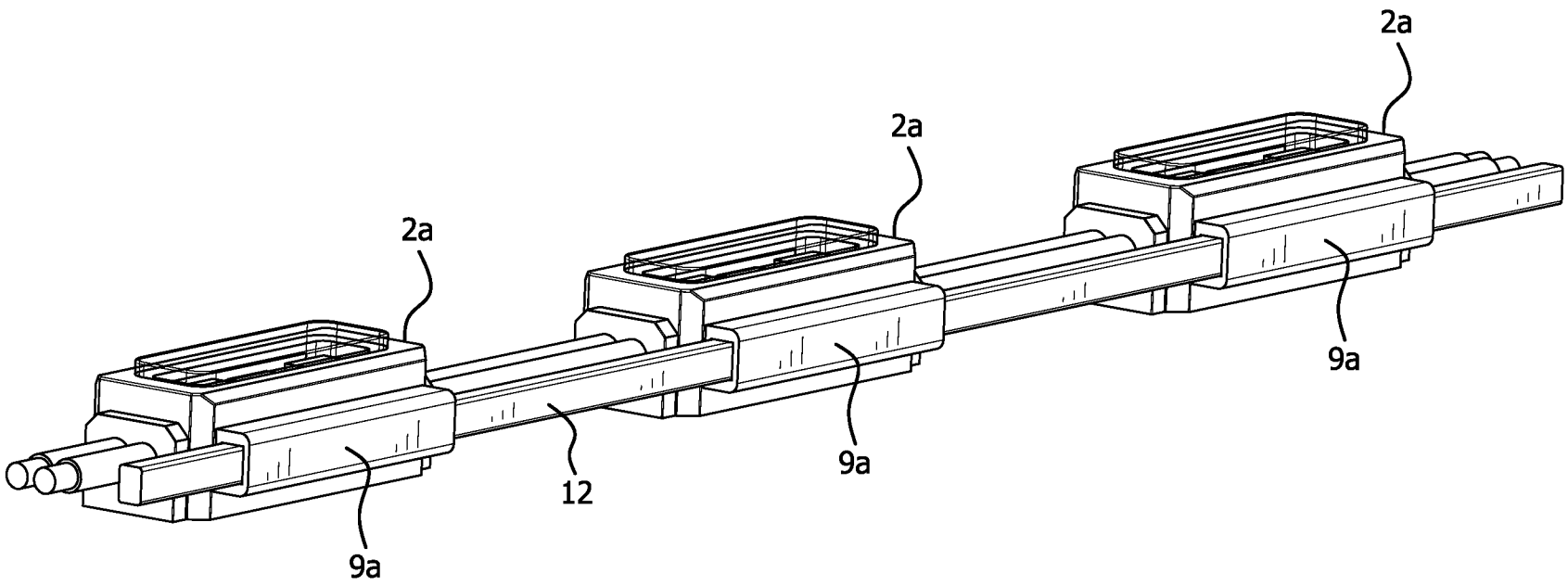
FIG. 5 is a view of a segment of an alternate embodiment of aligned LED modules taken from an illuminated signage system utilizing the present invention.

Alternatively, LED modules 2*a*, comprising main body 3*a*, LED lights 4*a*, 5*a*, and 6*a*, and input and output wiring 7*a* and 8*a*, has support member 9*a* extending from sidewall 10*a* of the LED module. Support member 9*a* can take the shape of an enclosed member having channel opening 13. See FIG. 4. Wire member 12 extends through channel openings 13 to maintain LED modules 2*a* in alignment.

Enclosed support members 9*a* can be attached to sidewalls 10*a* or they also can be integrally molded with the LED modules themselves. It is specifically noted that the shape of the support members should not be considered restricted to those described in the herein disclosure. It is contemplated that any effectively shaped support member can be utilized.

By the present invention, LED modules lighting configurations can be quickly and easily provided as LED module support systems for installation into lighting signage channels. The installer simply needs to feed wire member 12 through support members 9 of LED modules 2 and properly space the modules along the wire member. Either before or after the positioning of LED modules 2 along wire member 12, the wire member can be bent, flexed and formed into the desired shape and design, for inclusion into the lighting signage.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED modules support system for signage lighting comprising:

a plurality of aligned LED modules each comprising a module body having LED lights, a sidewall, and electrical wiring extending into, through, and out of the module body, each of said LED modules having a peripheral support member connected to and extending outward from the sidewall of the module body, each support member having a through opening extending the length of the support member and externally of the module body;

a flexible, deformable wire member formed into a signage lighting configuration, said wire member located externally of each of the module bodies and positioned in and through the openings of the support members of each of the plurality of LED modules, wherein the wire member within the support members traverses alongside and externally of each of the module bodies, said wire member retaining the LED modules in spaced alignment along the wire member; and an electrical power source for providing electricity through the electrical wiring to the aligned LED modules in order to illuminate the LED modules.

2. The LED modules support system as in claim 1 wherein the support members of each of the LED modules is an inverted "U" having a U-shaped tunnel, the wire member extending through the U-shaped tunnels.

3. The LED modules support system as in claim 1 wherein the support members of each of the plurality of LED modules is enclosed and has a through opening, the wire member extending through the openings within the enclosed support members.

4. A method of installing LED modules into channel containing lighting signage comprising the steps of:

providing a plurality of LED modules, each of the LED modules comprising a module body having LED lights, a sidewall, and electrical wiring extending into, through, and out of the module body, each of said LED modules having a peripheral support member connected to and extending outward from the sidewall of the module body, each support member having a through opening extending the length of the support member and externally of the module body;

providing a flexible, deformable, wire member;

feeding the wire member through the openings of the support members of each of the LED modules such that the wire member is located externally and traverses alongside each of the module bodies;

spacing the LED modules along the wire member;

forming the wire member with the spaced LED modules, into a signage lighting configuration; and positioning the wire member with the spaced LED modules into signage lighting.

* * * * *